US011735880B1

(12) United States Patent
Wu et al.

(10) Patent No.: US 11,735,880 B1
(45) Date of Patent: Aug. 22, 2023

(54) LIGHT BULB HOLDER STRUCTURE AND LIGHT BULB HAVING SAME

(71) Applicant: ZHANGZHOU GO WIN LIGHTING CO., LTD, Zhangzhou (CN)

(72) Inventors: Qingan Wu, Zhangzhou (CN); Xiongzhong Lin, Zhangzhou (CN); Bihai Wang, Zhangzhou (CN)

(73) Assignee: ZHANGZHOU GO WIN LIGHTING CO., LTD, Zhangzhou (CN)

( * ) Notice: Subject to any disclaimer, the term of this patent is extended or adjusted under 35 U.S.C. 154(b) by 0 days.

(21) Appl. No.: 18/074,530

(22) Filed: Dec. 5, 2022

(30) Foreign Application Priority Data

Nov. 10, 2022 (CN) ..... 202223001638.6

(51) Int. Cl.
*H01R 33/945* (2006.01)
*F21V 23/06* (2006.01)
*H01R 13/52* (2006.01)

(52) U.S. Cl.
CPC ..... *H01R 33/9453* (2013.01); *F21V 23/06* (2013.01); *H01R 13/5227* (2013.01)

(58) Field of Classification Search
CPC ..... F21S 4/10; F21V 23/06; H01R 13/5227; H01R 33/6453
See application file for complete search history.

(56) References Cited

U.S. PATENT DOCUMENTS 10,094,550 B2 * 10/2018 Chen ..... F21V 19/002

OTHER PUBLICATIONS

Innovation Q Plus search, US and International (Year: 2023).*

* cited by examiner

*Primary Examiner* — Anabel Ton

(57) ABSTRACT

A light bulb holder structure and a light bulb having same, in which the bulb cap of the light bulb holder is provided with a plurality of grooves in a tactful manner, and the depth of the grooves is greater than that of the external threads of the bulb cap, such that after the bulb cap is mounted on the light bulb and the light bulb is mounted on the light socket, the water accumulated between the light bulb holder structure and the light socket can be effectively discharged through the grooves. As a result, failure of the insulator (connector) on the light bulb holder structure caused by water accumulation can be avoided to a certain extent, thereby improving the reliability and safety of the light bulb.

8 Claims, 3 Drawing Sheets

LIGHT BULB HOLDER STRUCTURE AND LIGHT BULB HAVING SAME

CROSS-REFERENCE TO RELATED APPLICATIONS

This application is based upon and claims priority to Chinese Patent Application No. 202223001638.6, filed on Nov. 10, 2022, the entire contents of which are incorporated herein by reference.

TECHNICAL FIELD

The present disclosure relates to the technical field of light bulb structures, in particular to a light bulb holder structure and a light bulb having same.

BACKGROUND

Light bulb holder is a key part which connects the light bulb and socket. The light bulb holder can directly affect the service life and stability of the light bulb or lamp. Usually, most light bulb holders are not waterproof or only have limited waterproof ability, especially when the bulb is mounted transversely outdoors or in an environment lacking waterproof measures or means for avoiding water, water is likely to be accumulated with a certain thickness between the socket and bulb when the light gets wet by water (the stability of the water accumulation is improved since water gets into the space between the light bulb holder and the socket and due to the viscosity of water). Since rain water or domestic water has impurities, the accumulation of rain water or domestic water between the socket and light bulb holder of a light will reduce the insulating property of the insulating region, thus resulting in electrodischarge and ignition between the two electrodes of the light bulb holder, and eventually lead to erosion and failure of the electrodes of the light bulb.

In order to avoid short circuit and ignition caused by water accumulation between the light bulb holder and socket, currently some commercially available lights improve the reliability of the connection between the light bulb holder and socket by increasing the creepage distance. Creepage distance, as an important indicator of light bulbs, refers to the shortest path between two conductive parts or between a conductive part and a protective interface of equipment measured along the surface of insulation. By doing so, although failure caused by water accumulation between the light bulb holder and socket may be reduced to a certain degree, since most of light bulb holders are connected to the socket by threads, after the light bulb holder is tightly threaded into the socket, the accumulation of water between the light bulb holder and the socket will be improved due to the threads of the light bulb holder and the socket, and the the viscosity of water. As a result, the accumulated water cannot be discharged out of the socket in time (for example, be discharged by natural evaporation or under the effect of gravity). Therefore, how to effectively modify the structure of the light bulb holder to facilitate discharge of the accumulated water between the light bulb holder and the socket without changing the overall structure of the light bulb holder while ensuring the waterproof performance and stability of the light bulb holder is a very practical issue in the art.

SUMMARY

In view of this, one objective of the present disclosure is to provide a light bulb holder structure having reliable structure, convenient installation, and can facilitate the discharge of water accumulated between the light bulb holder and the socket after installation and use, and a light bulb having same.

In order to realize the above-mentioned objective, the present disclosure proposes the following technical solutions.

A light bulb holder structure includes a bulb cap and a connector connected to one end of the bulb cap. The connector is made of insulating material, and a center of the connector is provided with a through hole for inserting a conductive element. A first end of the bulb cap is connectable with a light socket, and an outer circumferential wall of the bulb cap is provided with external threads connectable with the light socket. A second end of the bulb cap is connectable with a bulb housing. The outer circumferential wall of the bulb cap is provided with more than three grooves extending from the first end to the second end of the bulb cap.

As a possible implementation, further, the grooves are arranged at equal intervals around the outer circumferential wall of the bulb cap and form a circular array.

As a preferred implementation, preferably, a depth of the grooves is greater than a depth of the external threads.

As a preferred implementation, preferably, a difference between the depth of the grooves and the depth of the external threads ranges 0.2-0.5 mm.

As a possible implementation, further, a width of the grooves ranges 0.8-2 mm.

As a possible implementation, further, four grooves are provided.

As a preferred implementation, preferably, the connector is integrally formed on one end of the bulb cap. The center of the connector is provided with a protrusion extending in a direction away from the bulb cap. A center of the protrusion is provided with a through hole for inserting the conductive element. The first end of the bulb cap is provided with connection parts matched and connected with the connector. The connection parts are through holes or blind holes, and a threaded section of the connector is provided with convex parts at an end close to the bulb cap. The convex parts match with the connection parts in one-to-one correspondence and fill the connection parts. The grooves extends to the connector.

As a preferred implementation, preferably, the threaded section is provided on the connector at an end close to the bulb cap, and the threaded section matches with a structure of the first end of the bulb cap. Threads of the threaded section matches with the external threads.

As a preferred implementation, preferably, a length of the threaded section of the connector in an axial direction of the bulb cap is 0.1-0.3 times of a length of the bulb cap.

According to another aspect, the present disclosure also provides a light bulb, which has the above-mentioned light bulb holder structure.

Compared with the prior art, the present disclosure has the following advantages.

According to the present disclosure, the bulb cap of the light bulb holder is provided with a plurality of grooves in a tactful manner, and the depth of the grooves is greater than that of the external threads of the bulb cap, such that after the bulb cap is mounted on the light bulb and the light bulb is mounted on the light socket, the water accumulated between the light bulb holder structure and the light socket can be effectively discharged through the grooves. As a result, failure of the insulator (connector) on the light bulb holder structure caused by water accumulation can be avoided to a certain extent, thereby improving the reliability and safety of the light bulb.

BRIEF DESCRIPTION OF THE DRAWINGS

In order to make the description of the embodiments of the present disclosure or the technical solutions in the prior art clearer, drawings that are used for illustrating the embodiments or prior art are briefly introduced below. Obviously, the drawings described below merely contain some embodiments of the present disclosure. For those of ordinary skill in the art, other drawings may also be derived according to these drawings without creative efforts.

DETAILED DESCRIPTION OF THE EMBODIMENTS

Figure 1:
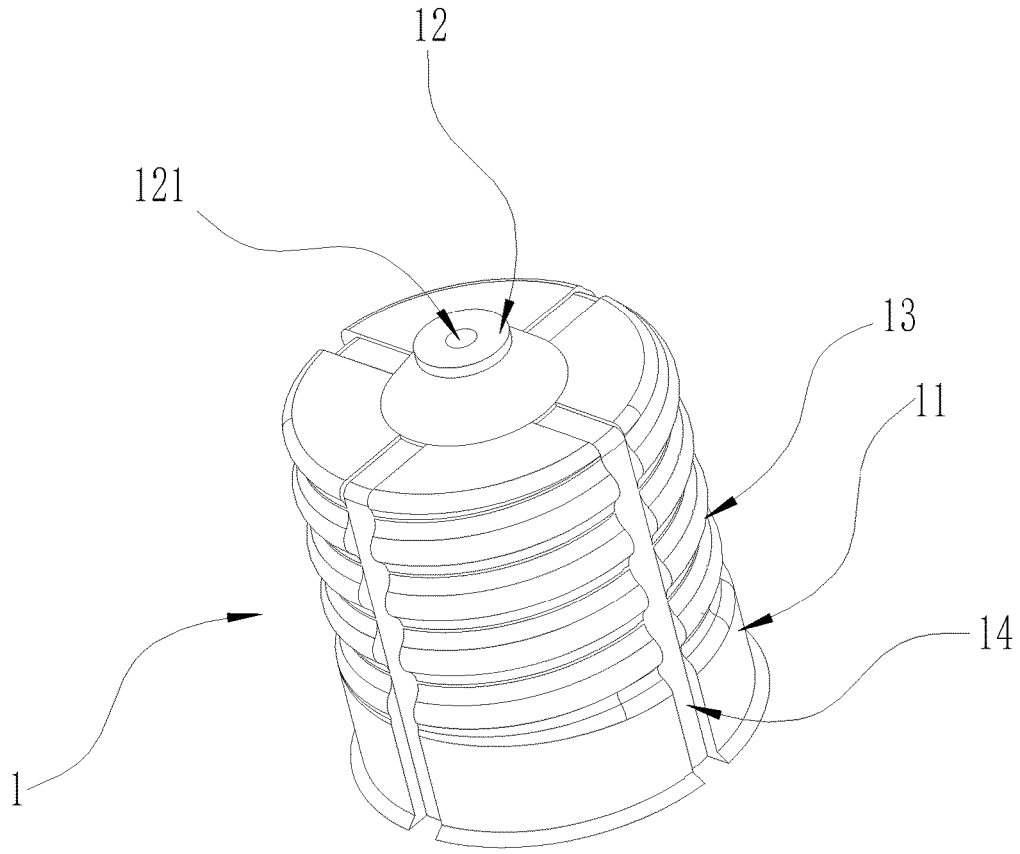
FIG. 1 is a structural schematic diagram briefly showing one implementation of a light bulb holder structure according to a first embodiment of the present disclosure.
Figure 2:
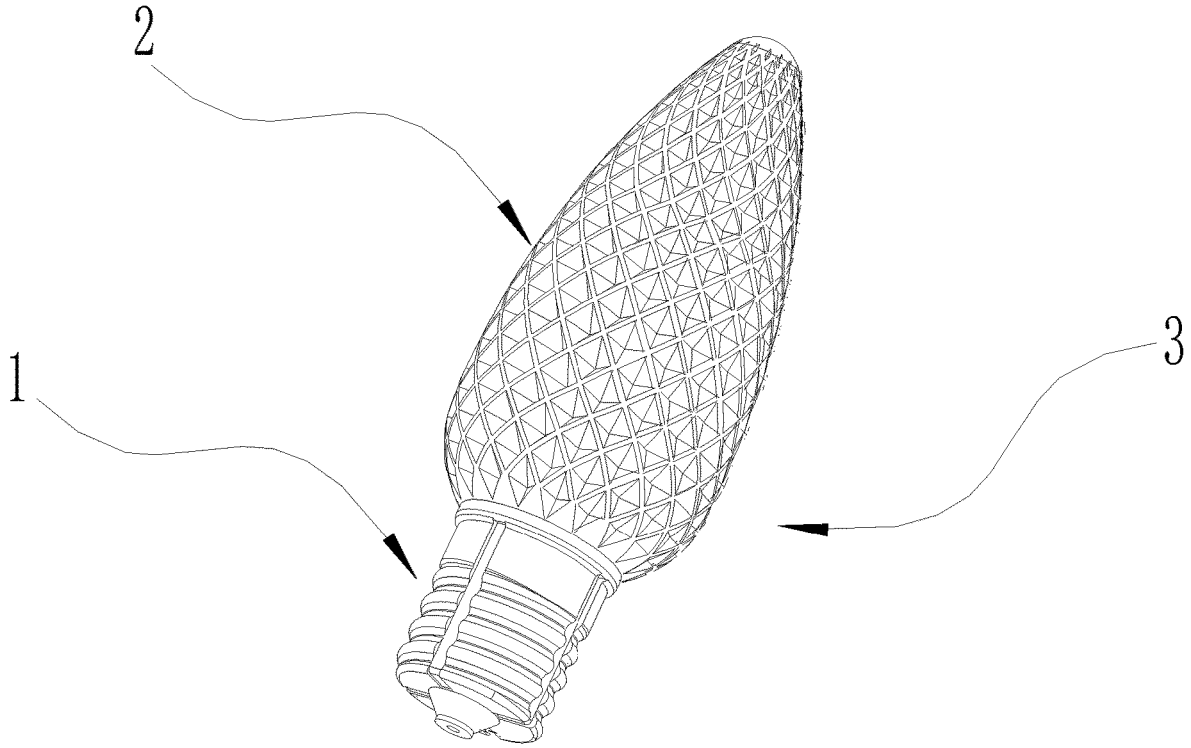
FIG. 2 is a structural schematic diagram briefly showing one implementation of the light bulb holder structure mounted on a light bulb according to the first embodiment of the present disclosure.
Figure 3:
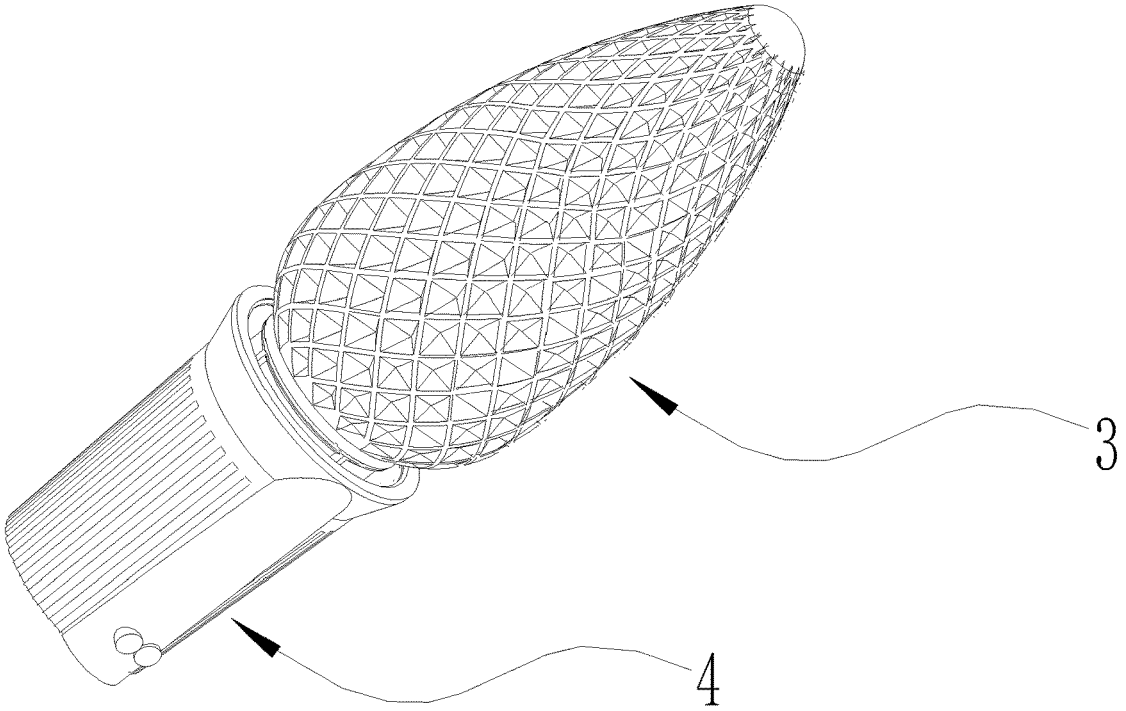
FIG. 3 is a structural schematic diagram briefly showing one implementation of the light bulb holder structure mounted on a light bulb and the light bulb mounted on a light socket according to the first embodiment of the present disclosure.
Figure 4:
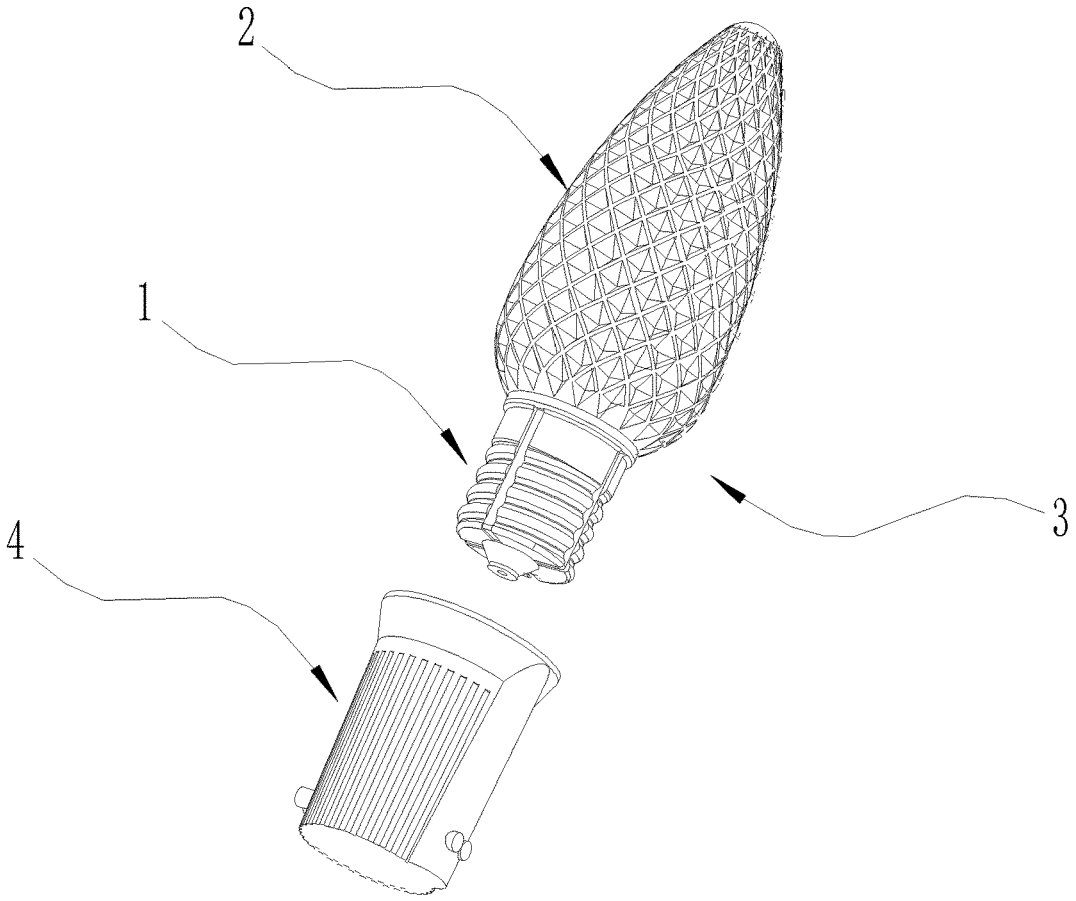
FIG. 4 is a structural schematic diagram briefly showing one implementation of the light bulb holder structure mounted on a light bulb while the light bulb has not mounted on the light socket according to the first embodiment of the present disclosure.
Figure 5:
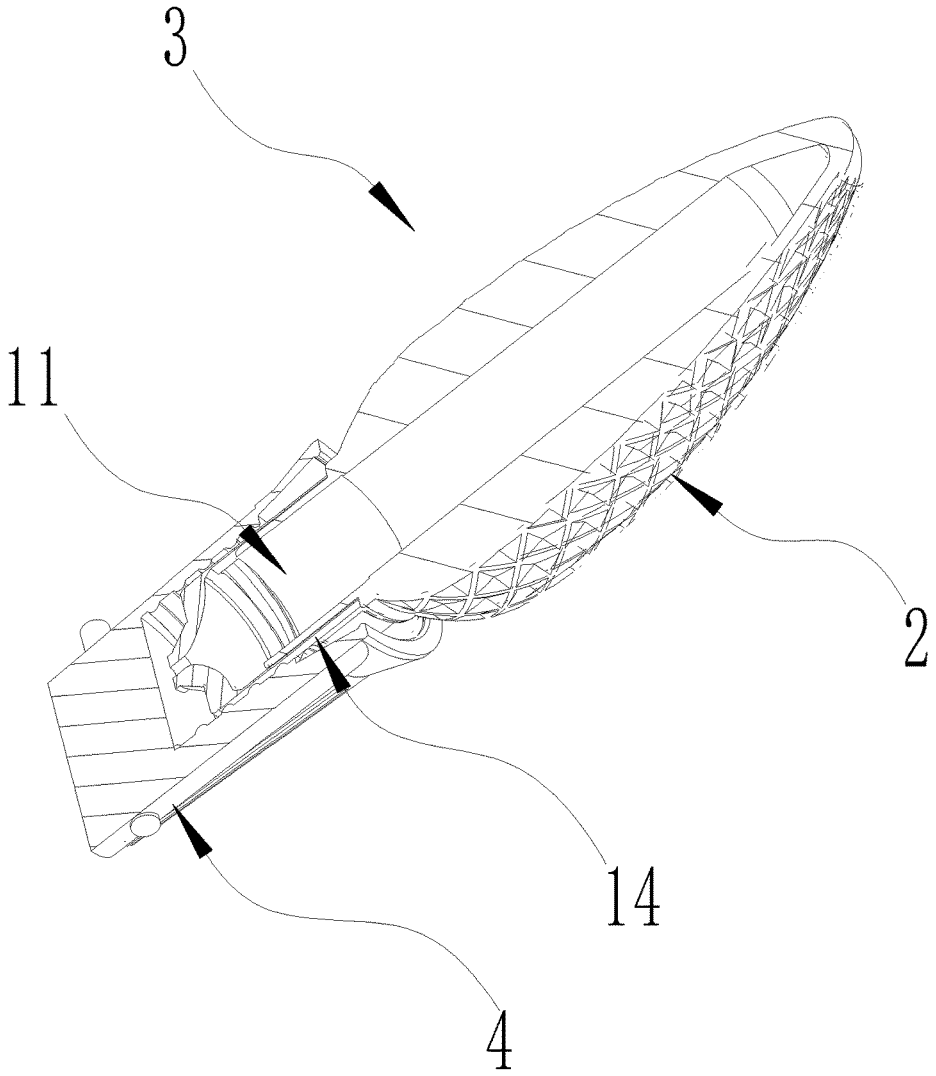
FIG. 5 is a cross sectional view of the structure shown in FIG. 3.

The present disclosure will be further described in detail below with reference to the accompanying drawings and embodiments. It is particularly pointed out that the following embodiments are only used to illustrate the present disclosure rather than limit the scope of the present disclosure. Likewise, the following embodiments constitute part of rather than all embodiments of the present disclosure, and all other embodiments derived by those of ordinary skill in the art without creative effort fall within the scope of protection of the present disclosure.

Embodiment 1

As shown in FIGS. 1-5, the present embodiment provides a light bulb holder structure 1, which includes a bulb cap 11 and a connector 12 connected to one end of the bulb cap 11. The connector 12 is made of insulating material (for example, plastics or silicone). The center of the connector 12 is provided with a through hole 121 for inserting a conductive element (in practice, conductive element may be conductive rivet). A first end of the bulb cap 11 is connectable with a light socket 4, and an outer circumferential wall of the bulb cap 11 is provided with external threads 13 connectable with the light socket 4. A second end of the bulb cap 11 is connectable with a bulb housing 2. The outer circumferential wall of the bulb cap 11 is provided with more than three grooves 14 extending from the first end to the second end of the bulb cap 11. In the present embodiment, the quantity of the grooves 14 is four, and the grooves 14 are arranged at equal intervals around the outer circumferential wall of the bulb cap 11 and form a circular array.

Since when the external threads 13 on the bulb cap 11 are connected with the light socket 4, the external threads 13 and the internal threads on the light socket 4 are engaged in a relatively tight state, and a narrow gap is formed therebetween. Therefore, in order to improve the reliability of the water discharge performance of the grooves 14, in the present embodiment, the depth of the grooves 14 is greater than the depth of the external threads 13. Preferably, the difference between the depth of the grooves 14 and the depth of the external threads 13 is 0.2-0.5 mm. The width of the grooves 14 is 0.8-2 mm.

Based on FIG. 1 and combined with what is shown in FIG. 2 to FIG. 5, in the present embodiment, when the above-mentioned light holder structure 1 is assembled with a bulb to make a light bulb 3, the grooves 14 do not penetrate through the inner wall of the bulb cap 11. Therefore, the structural strength of the light bulb 3 will not be affected since the light bulb holder structure 1 is not the main stress bearing component. Since the depth of the grooves 14 is greater than the depth of the external threads 13, after the light bulb 3 is mounted on the socket 4, the grooves 14 can also effectively guide and discharge the water accumulated between the socket 4 and the light bulb 3.

Embodiment 2

Figure 6:
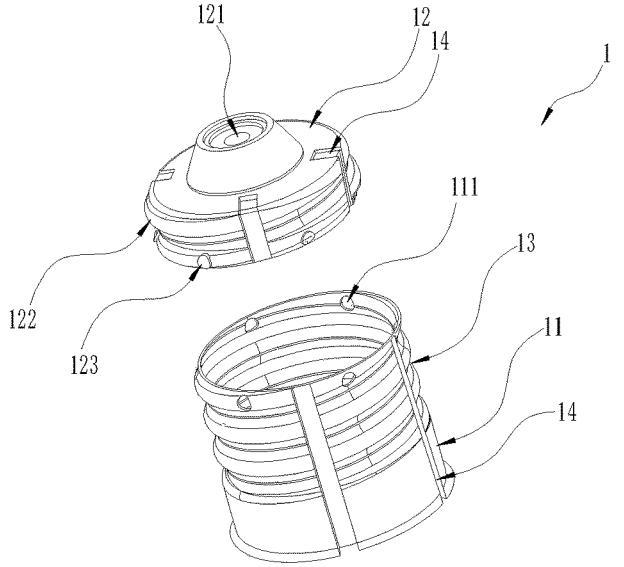
FIG. 6 is a structural schematic diagram briefly showing one implementation of a light bulb holder structure according to a second embodiment of the present disclosure.

As shown in FIG. 6, the structure of this embodiment is substantially the same as that of embodiment 1, the difference is that in this embodiment, the connector 12 is integrally formed at one end of the bulb cap 11. The center of the connector 12 is provided with a protrusion extending in a direction away from the bulb cap 11, and the center of the protrusion is provided with a through hole 121 for inserting a conductive element. One end of the bulb cap 11 is provided with connection parts 111 matched with the connector, and the connection parts 111 are through holes (or blind holes). A threaded section 122 of the connector 12 is provided with convex parts 123 at an end close to the bulb cap 11. The convex parts 123 match with the connection parts 111 in one-to-one correspondence and fill the connection parts 111. The grooves 14 extend to the connector 12. Specifically, the grooves 14 straightly extend through the outer wall of the bulb cap 11 in length direction and further straightly extend through the outer wall of the connector 12 to a top surface of the connector where the protrusion is located.

According to the present embodiment, the threaded section 122 is provided on the connector 12 at an end close to the bulb cap 11, and the threaded section 122 matches with a structure of the first end of the bulb cap 11. Threads of the threaded section 122 matches with the external threads 13. In terms of dimension, in the present embodiment, a length of the threaded section 122 of the connector 12 in an axial direction of the bulb cap 11 is 0.1-0.3 times of a length of the bulb cap 11.

In this embodiment, the connector 12 is lengthened and protrudes outward, such that the creepage distance of the light is increased, which can further reduce the probability of failure caused due to water accumulation after installation and use.

The above descriptions merely involve part of the embodiments of the present disclosure, and are not intended to limit the scope of the present disclosure. Any equivalent device or equivalent process change made based on the contents of the description and drawings of the present disclosure, or same or similar structure directly or indirectly applied to other related technical fields should be considered as falling within the scope of protection of the present disclosure.

What is claimed is:

1. A light bulb holder structure, comprising:

a bulb cap; and a connector connected to one end of the bulb cap; wherein the connector is made of insulating material, and a center of the connector is provided with a through hole for inserting a conductive element;

a first end of the bulb cap is connectable with a light socket, and an outer circumferential wall of the bulb cap is provided with external threads connectable with the light socket, a second end of the bulb cap is connectable with a bulb housing, the outer circumferential wall of the bulb cap is provided with more than three grooves extending from the first end to the second end of the bulb cap;

a depth of the grooves is greater than a depth of the external threads, and a difference between the depth of the grooves and the depth of the external threads ranges 0.2-0.5 mm.

2. The light bulb holder structure according to claim 1, wherein the grooves are arranged at equal intervals around the outer circumferential wall of the bulb cap and form a circular array.

3. The light bulb holder structure according to claim 1, wherein a width of the grooves ranges 0.8-2 mm.

4. The light bulb holder structure according to claim 1, wherein four grooves are provided.

5. The light bulb holder structure according to claim 1, wherein the connector is integrally formed on one end of the bulb cap;

the center of the connector is provided with a protrusion extending in a direction away from the bulb cap;

a center of the protrusion is provided with a through hole for inserting the conductive element;

the first end of the bulb cap is provided with connection parts matched and connected with the connector;

the connection parts are through holes or blind holes;

a threaded section of the connector is provided with convex parts at an end close to the bulb cap, the convex parts match with the connection parts in one-to-one correspondence and fill the connection parts; and the grooves extend to the connector.

6. The light bulb holder structure according to claim 5, wherein the threaded section is provided on the connector at an end close to the bulb cap, and the threaded section matches with a structure of the first end of the bulb cap;

threads of the threaded section matches with the external threads.

7. The light bulb holder structure according to claim 6, wherein a length of the threaded section of the connector in an axial direction of the bulb cap is 0.1-0.3 times of a length of the bulb cap.

8. A light bulb, comprising a light bulb holder structure, wherein the light bulb holder structure comprises:

a bulb cap; and a connector connected to one end of the bulb cap; wherein the connector is made of insulating material, and a center of the connector is provided with a through hole for inserting a conductive element;

a first end of the bulb cap is connectable with a light socket, and an outer circumferential wall of the bulb cap is provided with external threads connectable with the light socket, a second end of the bulb cap is connectable with a bulb housing, the outer circumferential wall of the bulb cap is provided with more than three grooves extending from the first end to the second end of the bulb caps a depth of the grooves is greater than a depth of the external threads, and a difference between the depth of the grooves and the depth of the external threads ranges 0.2-0.5 mm.

* * * * *